US008893625B2

(12) United States Patent
Higashi et al.

(10) Patent No.: US 8,893,625 B2
(45) Date of Patent: Nov. 25, 2014

(54) RUBBER STOPPER

(75) Inventors: Kazuma Higashi, Osaka (JP); Hideki Fukumoto, Hyogo (JP); Masahiro Hamada, Hyogo (JP); Masahiro Sakahira, Hyogo (JP)

(73) Assignees: Toyo Tire & Rubber Co., Ltd., Osaka-shi (JP); Kawasaki Heavy Industries, Ltd., Kobe (JP)

( * ) Notice: Subject to any disclaimer, the term of this patent is extended or adjusted under 35 U.S.C. 154(b) by 299 days.

(21) Appl. No.: 13/212,526

(22) Filed: Aug. 18, 2011

(65) Prior Publication Data

US 2012/0228814 A1 Sep. 13, 2012

(30) Foreign Application Priority Data

Mar. 10, 2011 (JP) ..... 2011-052384

(51) Int. Cl.
*B61F 3/00* (2006.01)
*F16M 1/00* (2006.01)
*B61F 5/14* (2006.01)

(52) U.S. Cl.
CPC ..... *B61F 5/142* (2013.01)
USPC ..... 105/199.1; 267/140

(58) Field of Classification Search
USPC ..... 105/182.1, 199.1, 199.3, 199.4; 267/139, 140, 292; 188/381
See application file for complete search history.

(56) References Cited

U.S. PATENT DOCUMENTS 7,527,003 B1 * 5/2009 Schorr et al. ..... 105/199.3

FOREIGN PATENT DOCUMENTS

JP 11-208468 A 8/1999

* cited by examiner

*Primary Examiner* — R. J. McCarry, Jr.
(74) *Attorney, Agent, or Firm* — Westerman, Hattori, Daniels & Adrian, LLP

(57) ABSTRACT

The present invention provides a rubber stopper that can set a shape suitable for mounting and set a desired stopper characteristic. Specifically, a holding fitting 3 fastened to one member by means of bolting is provided. A rubber section 4 that abuts against the other member is held by the holding fitting 3. The holding fitting 3 has a partition wall 8 to divide between a peripheral edge of a bolt hole 7 and a holding section 9 that holds the rubber section 4. A rubber side abutment surface 12 in the rubber section 4 protrudes from a top of the partition wall 8. A bored section 13 is formed near the partition wall 8 of the rubber section 4. The bored section 13 increases durability of the rubber section 4. A size of the rubber stopper 1 is reduced.

16 Claims, 24 Drawing Sheets

RUBBER STOPPER

BACKGROUND OF THE INVENTION

1. Field of the Invention

The present invention relates to a rubber stopper that is fastened to, for example, a bogie of a railway vehicle by means of bolting and abuts against a link rod connecting the bogie side and the vehicle body side to limit lateral movement of the vehicle body.

2. Description of the Related Art

Generally, a railway vehicle has a structure in which a bogie vertically supports a vehicle body via an air spring or the like, and, for example, the bogie side and the vehicle body side are connected by a link rod that transmits forward and rearward forces such as a drive force and a brake force.

Also as shown in FIG. 24, a rubber stopper 101 is provided on the bogie side, and when the vehicle body side is significantly laterally displaced, the rubber stopper 101 abuts against a middle portion of a link rod 102 inclined with displacement of the vehicle body. The rubber stopper 101 abuts against the link rod 102 to limit lateral movement of the vehicle body side and ensure horizontal rigidity of the railway vehicle.

For example, Japanese Patent Laid-Open No. 11-208468 discloses such a rubber stopper in which a viscous material is sealed to increase damping performance and improve riding comfort.

SUMMARY OF THE INVENTION

However, the rubber stopper in Japanese Patent Laid-Open No. 11-208468 can expect a damping effect, but has a shape that tends to significantly influence various stopper characteristics such as damping performance, a spring constant, or durability. Thus, it is difficult to set a shape suitable for mounting to a bogie side and set a desired stopper characteristic.

The present invention has an object to provide a rubber stopper that can set a shape suitable for mounting and set a desired stopper characteristic.

In order to achieve the object, the present invention provides a rubber stopper for limiting relative displacement of a plurality of members, including: a holding fitting fastened by means of bolting to one of the plurality of members; and a rubber section that is held by the holding fitting and abuts against another of the plurality of members, wherein the holding fitting has a partition wall that divides between a peripheral edge of a bolt hole through which a fastening bolt is inserted and a holding section that holds the rubber section. Further, in the rubber section, a rubber side abutment surface that abuts against the other member is provided to protrude from a top of the partition wall, and a bored section is formed near the partition wall.

According to the above-described configuration, in the rubber section, the bored section is formed near the partition wall of the holding fitting. This can reduce local stress near the partition wall to increase durability of the rubber section, and thus reduce a size of the rubber stopper. Further, the rubber section firmly abuts against the other member to close the bored section. Thus, physical properties of rubber are selected depending on the size of the rubber stopper, thereby allowing a strength characteristic and a spring characteristic to be the same as those of a rubber stopper without a bored section. Thus, the rubber stopper is formed into a shape suitable for mounting to facilitate a change of a mounting pitch and allow a desired stopper characteristic to be set.

A configuration may be adopted in which the rubber side abutment surface is formed to be brought into surface contact with a portion of the other member against which the rubber side abutment surface abuts. According to this configuration, the rubber side abutment surface is formed into, for example, a curved shape and brought into surface contact with the other member. This allows dispersion of stress and can increase strength and durability of the rubber section as compared to a case where the rubber side abutment surface is brought into line or point contact with the other member.

A configuration may be also adopted in which a fitting side abutment surface that abuts against the other member to limit deformation of the rubber section is formed in the holding fitting, and the fitting side abutment surface is formed to be brought into surface contact with a portion of the other member against which the fitting side abutment surface abuts. According to this configuration, the fitting side abutment surface is formed into, for example, a curved surface and brought into surface contact with the other member. This allows dispersion of stress and can increase strength and durability of the rubber section as compared to a case where the fitting side abutment surface is brought into line or point contact with the other member.

A mounting spot of the rubber stopper is not particularly limited. By way of example, the rubber stopper may be fastened to a bogie of a railway vehicle by means of bolting so that the rubber side abutment surface abuts against a link rod that connects the bogie and a vehicle body to transmit forward and rearward forces to limit lateral movement of the link rod relative to the bogie side and limit lateral movement of the vehicle body side. The rubber stopper fastened to the bogie by means of bolting can be placed in a narrow space, and further, the link rod firmly and repeatedly abuts against the rubber side abutment surface. Thus, the configuration of the present invention is particularly suitably adopted.

As described above, according to the present invention, the bored section is formed near the partition wall in the rubber section to increase durability of the rubber section. This can reduce a size of the rubber stopper, allows the rubber stopper to have a shape suitable for mounting, and facilitates a change of a mounting pitch of the rubber stopper. Further, physical properties of rubber are selected depending on the size of the rubber stopper, thereby allowing a desired stopper characteristic to be the same as those of a rubber stopper without a bored section.

DETAILED DESCRIPTION OF THE INVENTION

Figure 1:
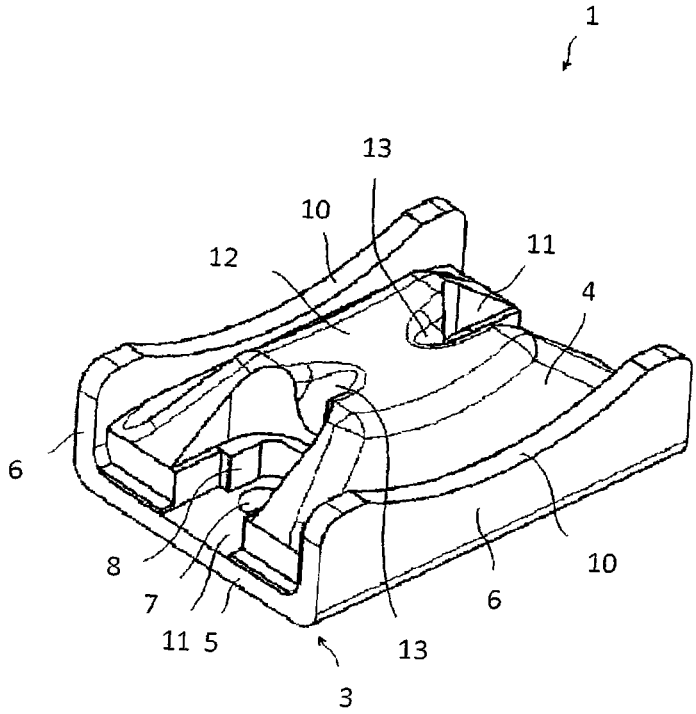
FIG. 1 is a perspective view of a rubber stopper according to the present invention.
Figure 2:
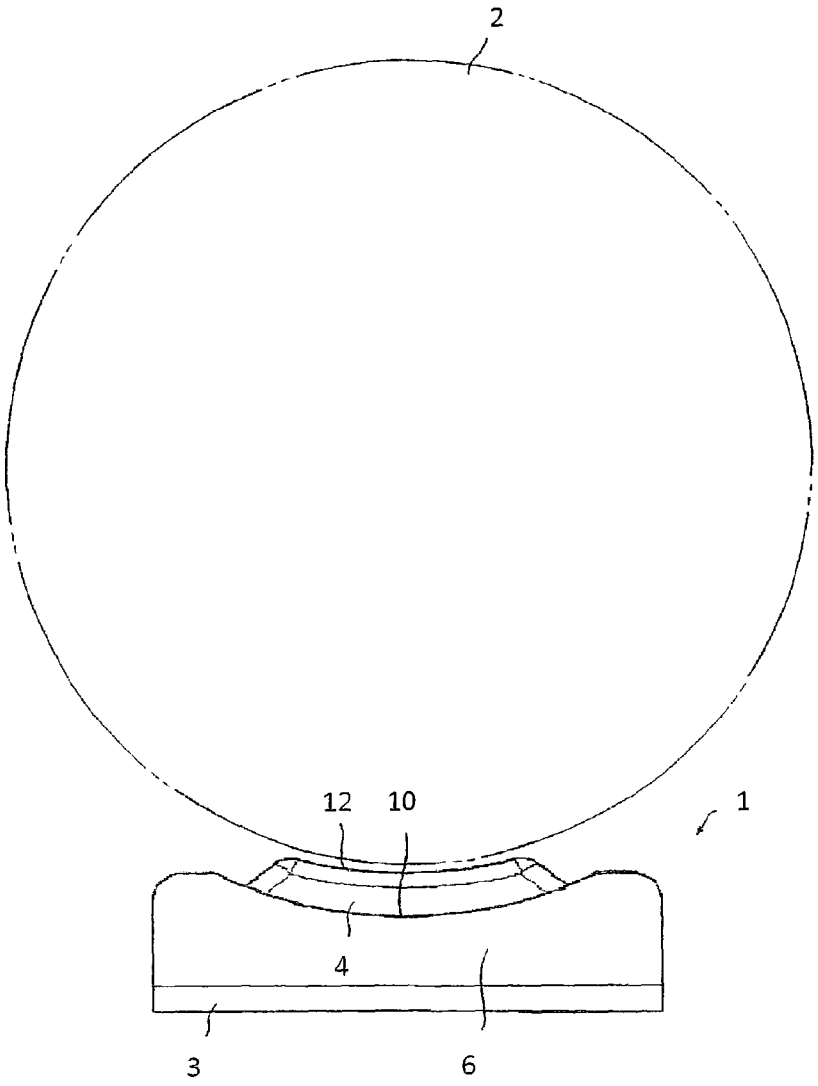
FIG. 2 is a side view of the rubber stopper.
Figure 3:
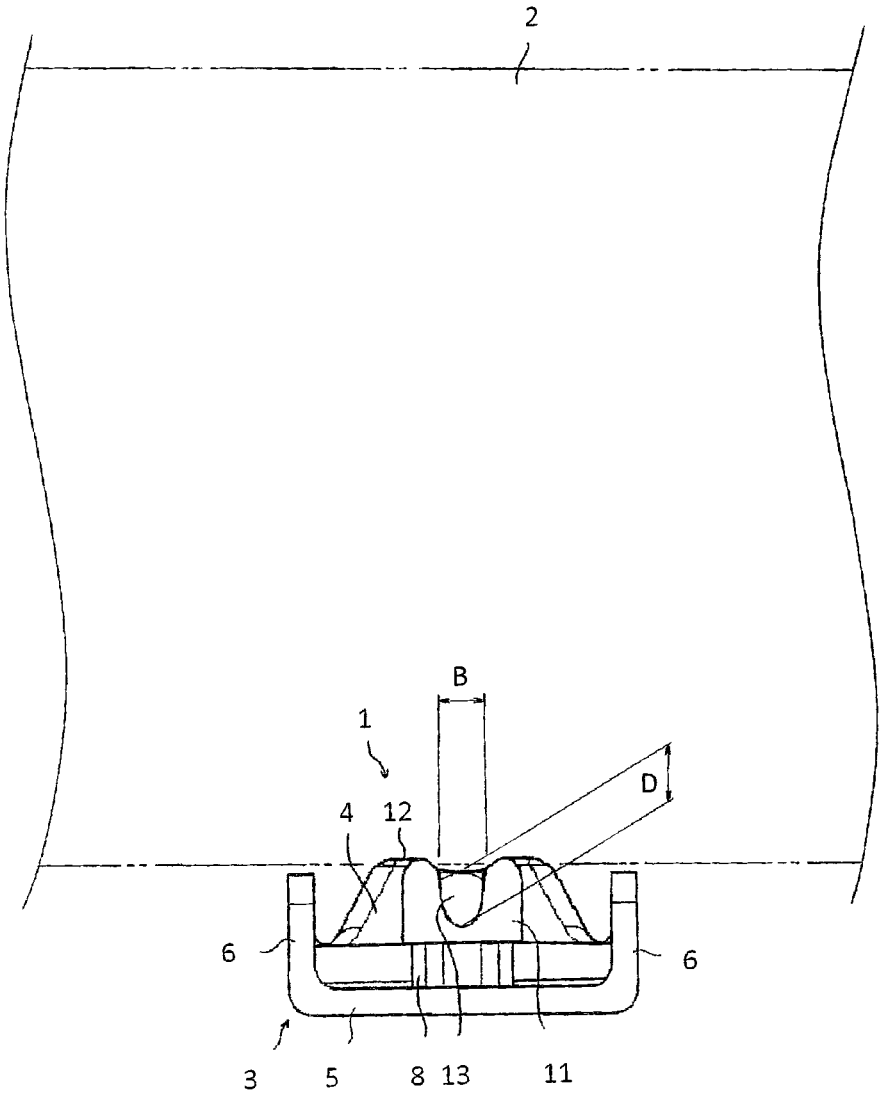
FIG. 3 is a front view of the rubber stopper.
Figure 4:
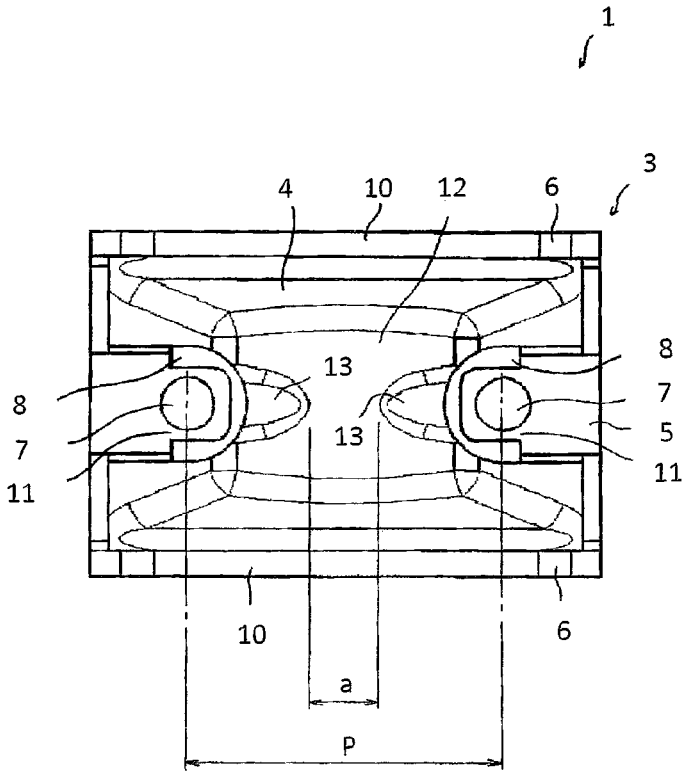
FIG. 4 is a plan view of the rubber stopper.
Figure 5:
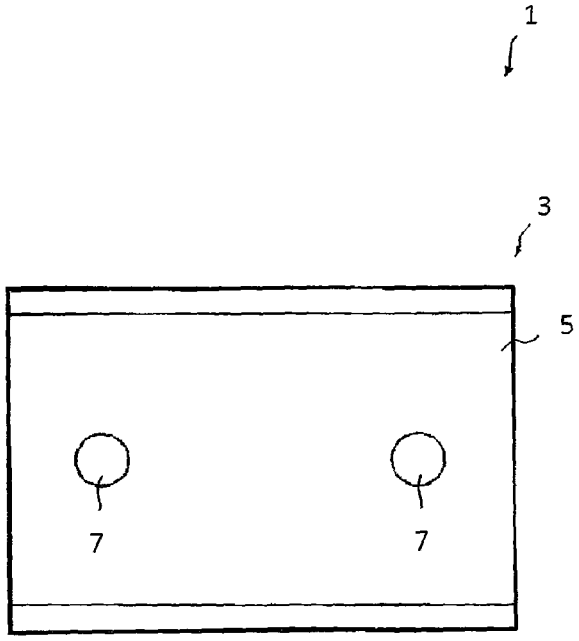
FIG. 5 is a bottom view of the rubber stopper.
Figure 6:
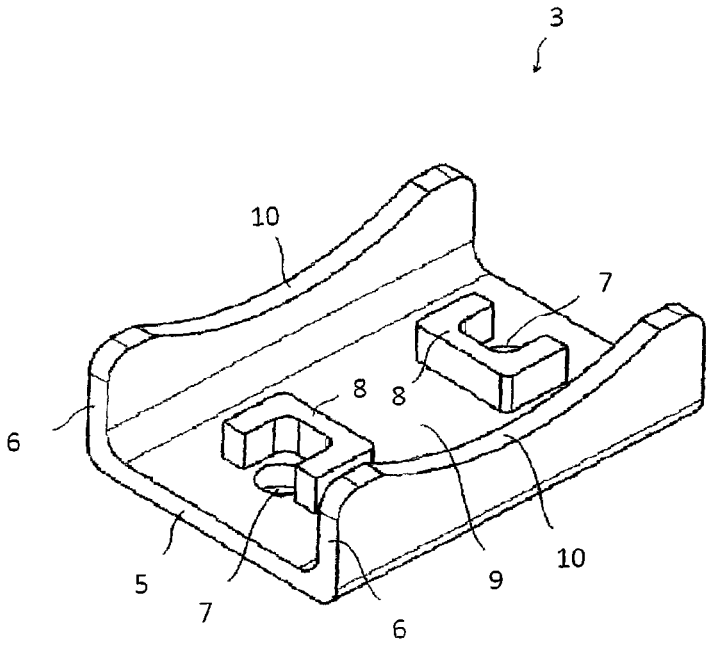
FIG. 6 is a perspective view of a holding fitting.
Figure 7:
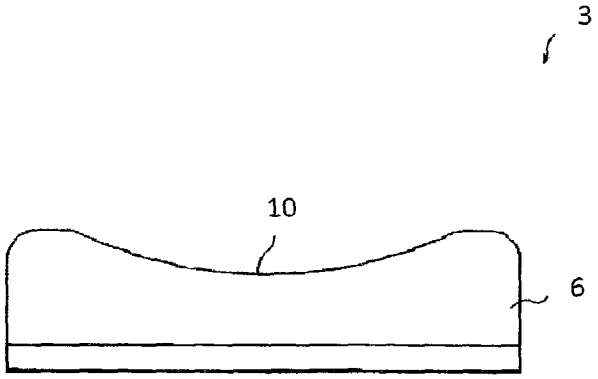
FIG. 7 is a side view of the holding fitting.
Figure 8:
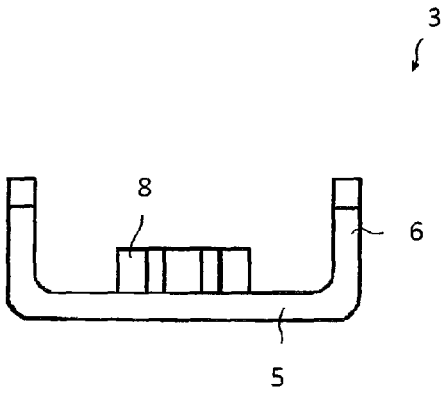
FIG. 8 is a front view of the holding fitting.
Figure 9:
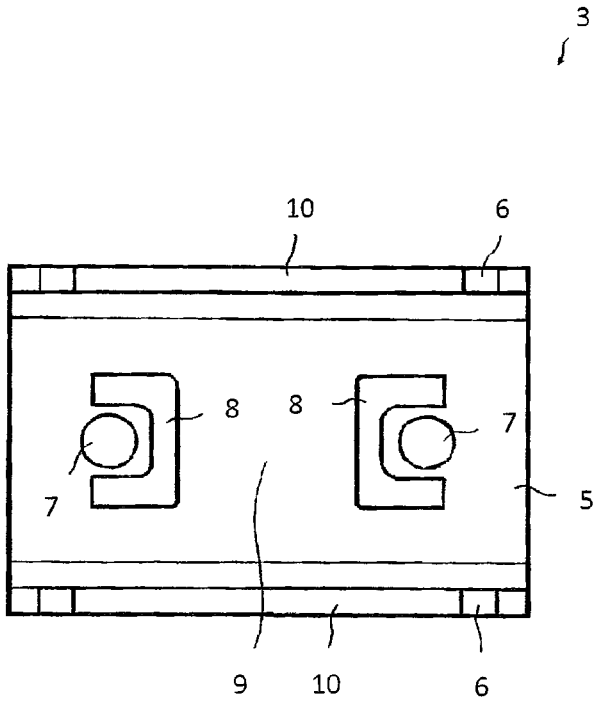
FIG. 9 is a plan view of the holding fitting.
Figure 10:
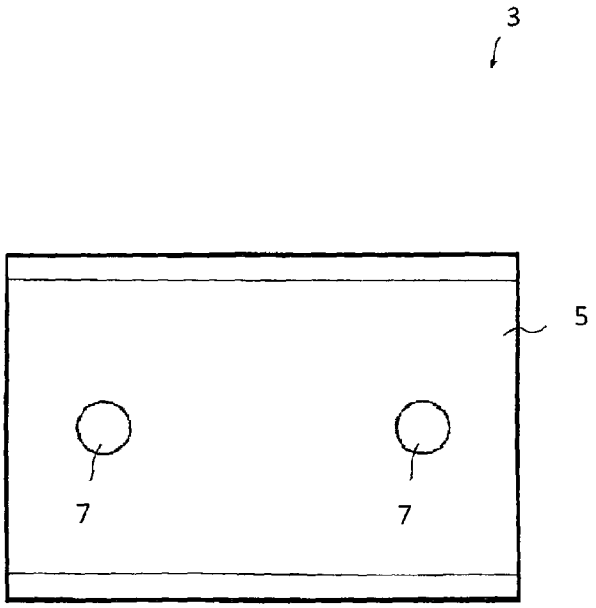
FIG. 10 is a bottom view of the holding fitting.
Figure 11:
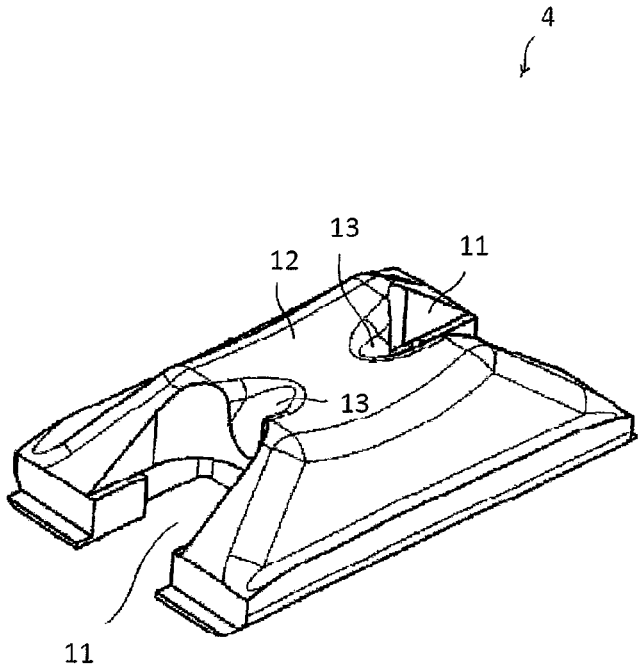
FIG. 11 is a perspective view of a rubber section.
Figure 12:
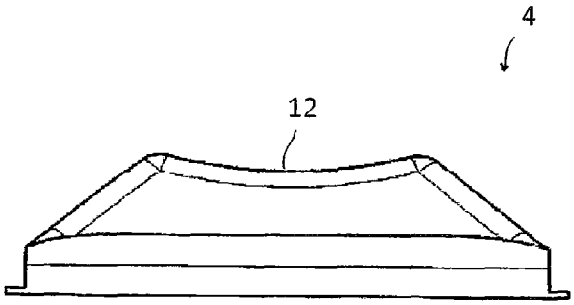
FIG. 12 is a side view of the rubber section.
Figure 13:
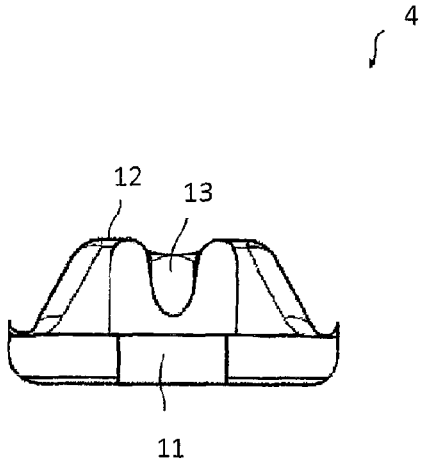
FIG. 13 is a front view of the rubber section.
Figure 14:
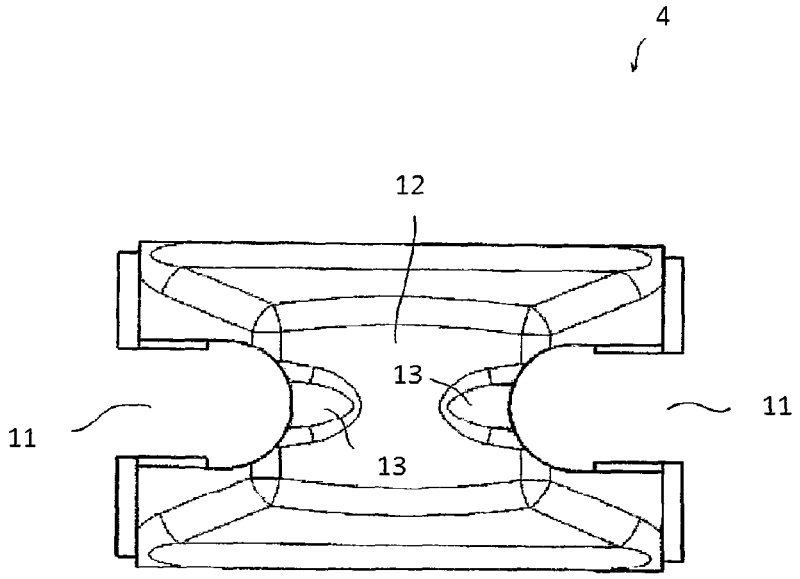
FIG. 14 is a plan view of the rubber section.
Figure 15:
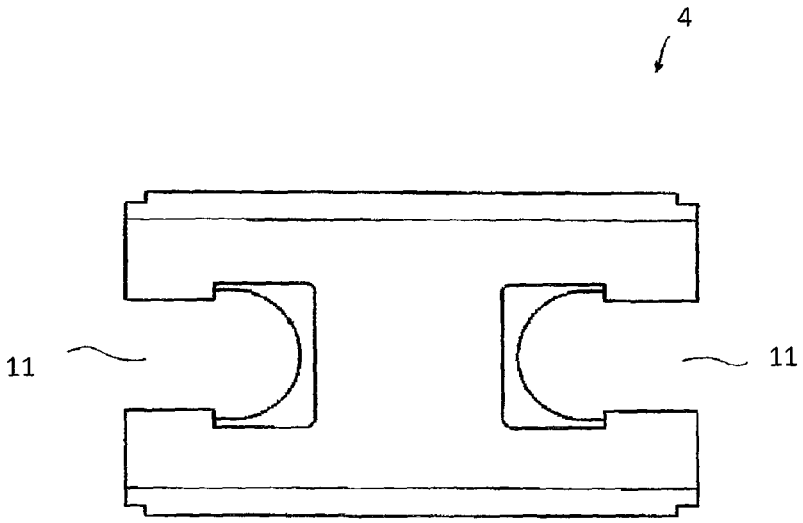
FIG. 15 is a bottom view of the rubber section.
Figure 16:
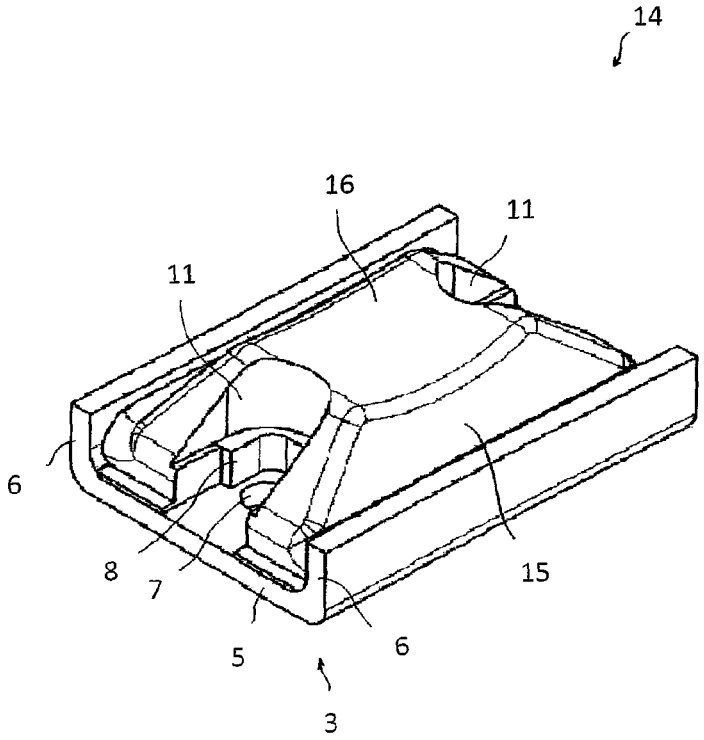
FIG. 16 is a perspective view of a rubber stopper without a bored section.
Figure 17:
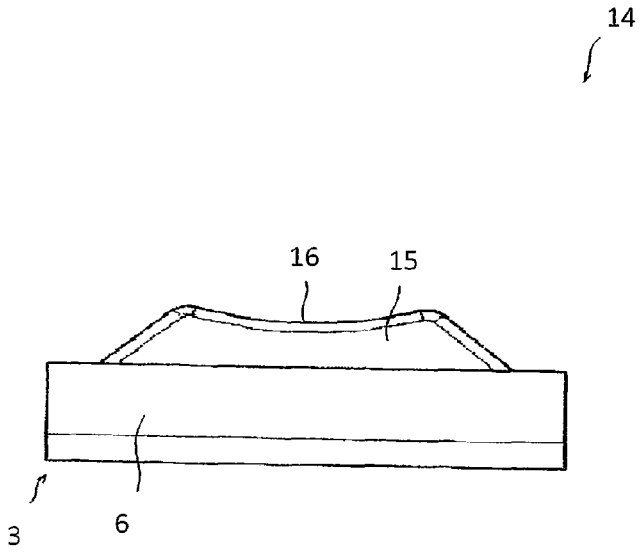
FIG. 17 is a side view of the rubber stopper without a bored section.
Figure 18:
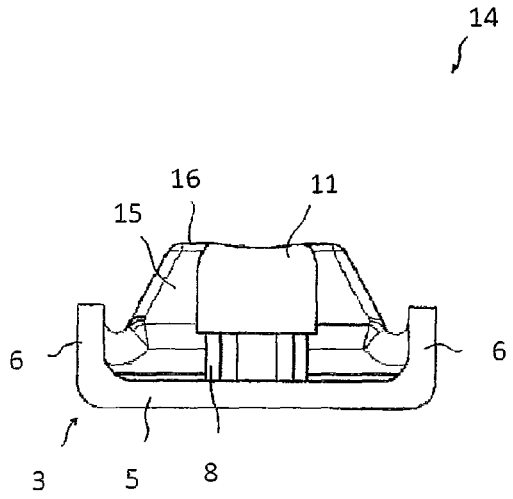
FIG. 18 is a front view of the rubber stopper without a bored section.
Figure 19:
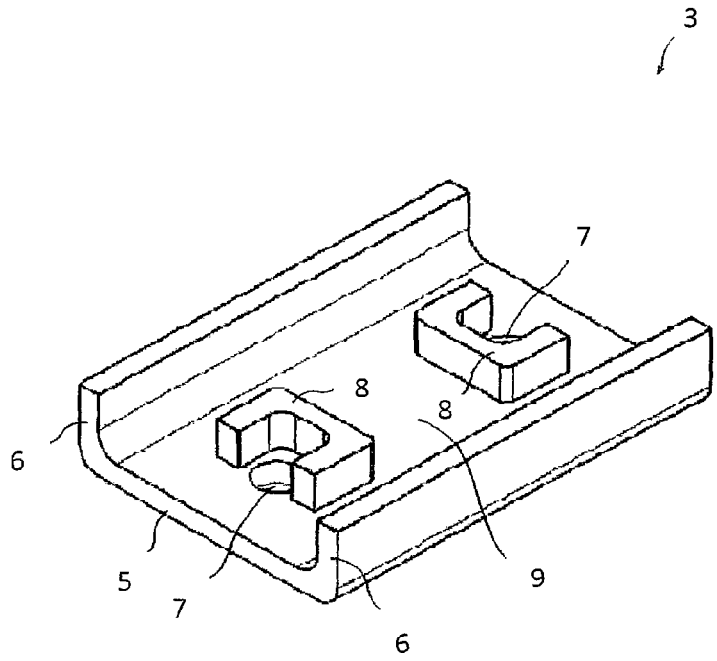
FIG. 19 is a perspective view of a holding fitting of the rubber stopper without a bored section.
Figure 20:
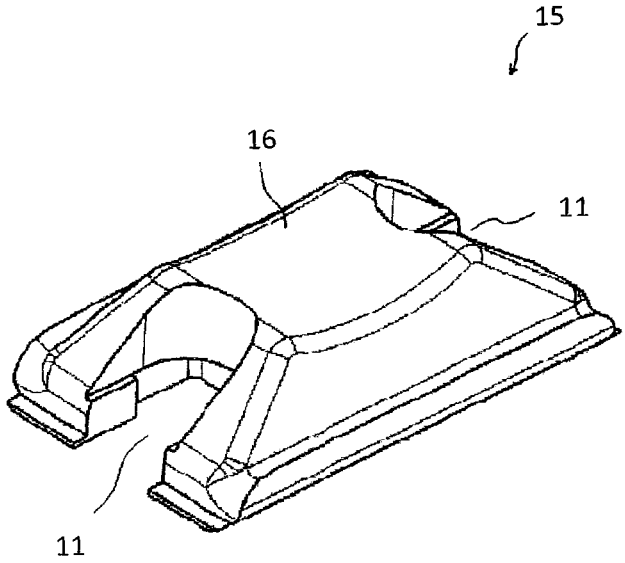
FIG. 20 is a perspective view of a rubber section of the rubber stopper without a bored section.

Now, an embodiment for carrying out a rubber stopper according to the present invention will be described with reference to the drawings.

As shown in FIGS. 1 to 5, a rubber stopper 1 abuts against a link rod 2 that connects, for example, a bogie and a vehicle body of a railway vehicle to transmit forward and rearward forces, and limits lateral movement of the link rod 2 relative to the bogie to limit lateral movement of the vehicle body. The rubber stopper 1 includes a holding fitting 3 fastened to the bogie side by means of bolting, and a rubber section 4 that is held by the holding fitting 3 and abuts against the link rod 2.

As shown in FIGS. 6 to 10, the holding fitting 3 is, for example, made of steel, and has a U shape formed by raising side plates 6 from opposite edges in a width direction of a rectangular bottom plate 5. In a middle portion in the width direction of the bottom plate 5, two bolt holes 7 through which fastening bolts are inserted are formed with a bolt space (P) therebetween.

On an upper surface of the bottom plate 5, two U-shaped partition walls 8 are formed to surround the bolt holes 7 from a middle side in a longitudinal direction and opposite sides in the width direction. Each of the partition walls 8 divides between a peripheral edge of the bolt hole 7 and a holding section 9 that holds the rubber section 4 on the upper surface of the bottom plate 5.

An upper edge of the side plate 6 is a fitting side abutment surface 10 that abuts against the link rod 2 to prevent further pressing by the link rod 2 and limit deformation of the rubber section 4, and has a recessed and arcuate middle portion. A radius of curvature of the fitting side abutment surface 10 is substantially the same as a radius of curvature of an outer peripheral surface of the link rod 2 having a circular section. The fitting side abutment surface 10 is brought into surface contact with the link rod 2. A bottom portion in the middle of the fitting side abutment surface 10 is set to be higher than a top of the partition wall 8 to prevent the link rod 2 from abutting against the partition wall 8.

As shown in FIGS. 11 to 15, the rubber section 4 is a rubber member having a substantially quadrangular pyramidal shape, and a bottom surface of the rubber section 4 has substantially the same shape as the bottom plate 5 of the holding fitting 3. A U-shaped notch 11 is formed in a middle portion on each of opposite sides in the longitudinal direction of the rubber section 4 so as to prevent interference with the partition wall 8. The rubber section 4 is placed on the holding section 9 of the holding fitting 3 so that a bottom of the notch 11 covers an outer edge of the top of the partition wall 8.

An upper surface of the rubber section 4 is a rubber side abutment surface 12 that is formed to protrude from the fitting side abutment surface 10, and abuts against the link rod 2 to limit relative movement of the link rod 2. The rubber side abutment surface 12 is formed to be recessed and curved. A radius of curvature of the rubber side abutment surface 12 is substantially the same as a radius of curvature of the outer peripheral surface of the link rod 2 having a circular section, and the rubber side abutment surface 12 is brought into surface contact with the link rod 2.

Near the partition wall 8 in the rubber side abutment surface 12, a bored section 13 is formed by, for example, recessing the rubber side abutment surface 12 into a substantially semi-oval shape, and reduces local stress of the rubber section 4, generated by deformation of the rubber section 4 being restrained by the partition wall 8. For the bored section 13, a bottom is set to a depth (D) higher than the top of the partition wall 8, a maximum width (B) is narrower than that of the partition wall 8, and further a length (a) of a portion of the rubber side abutment surface 12 between the bored sections 13 is, for example, substantially the same length as that of the bored section 13.

Next, behavior of the rubber stopper 1 when the link rod 2 abuts against the rubber stopper 1 will be described as compared to a rubber stopper 14 without a bored section.

First, a configuration of the rubber stopper 14 without a bored section will be described. As shown in FIGS. 16 to 20, the rubber stopper 14 has substantially the same configuration as the rubber stopper 1 according to the present invention, but a bored section is not formed in a rubber section 15, and a rubber side abutment surface 16 is formed on an entire range including a portion near a partition wall 8.

Figure 21:
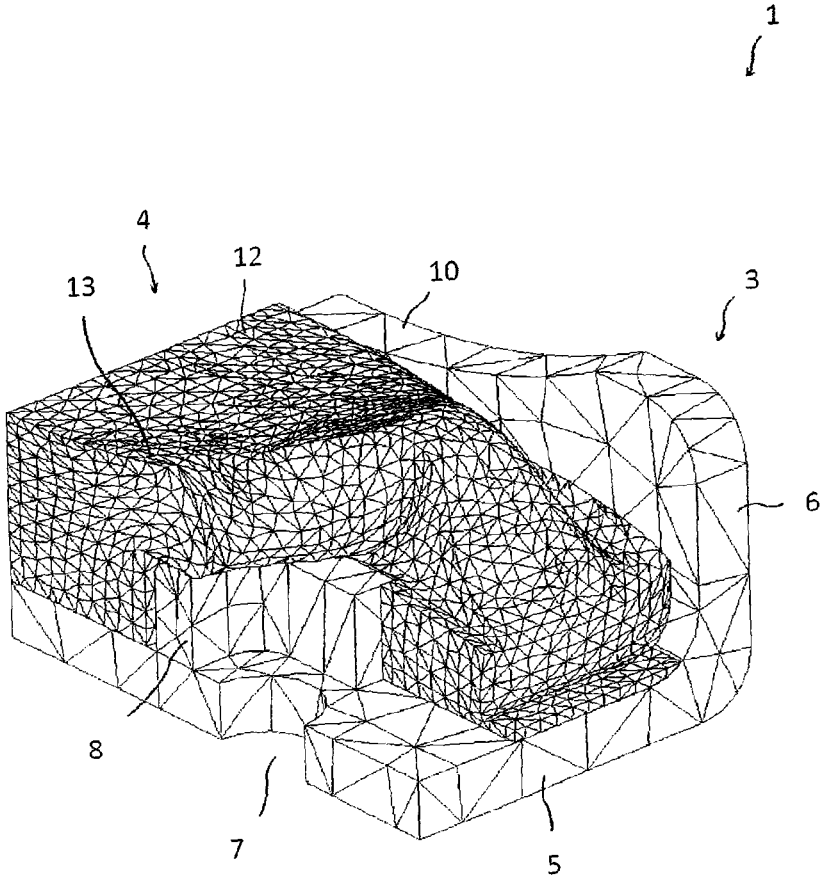
FIG. 21 shows a deformed state of the rubber stopper.
Figure 22:
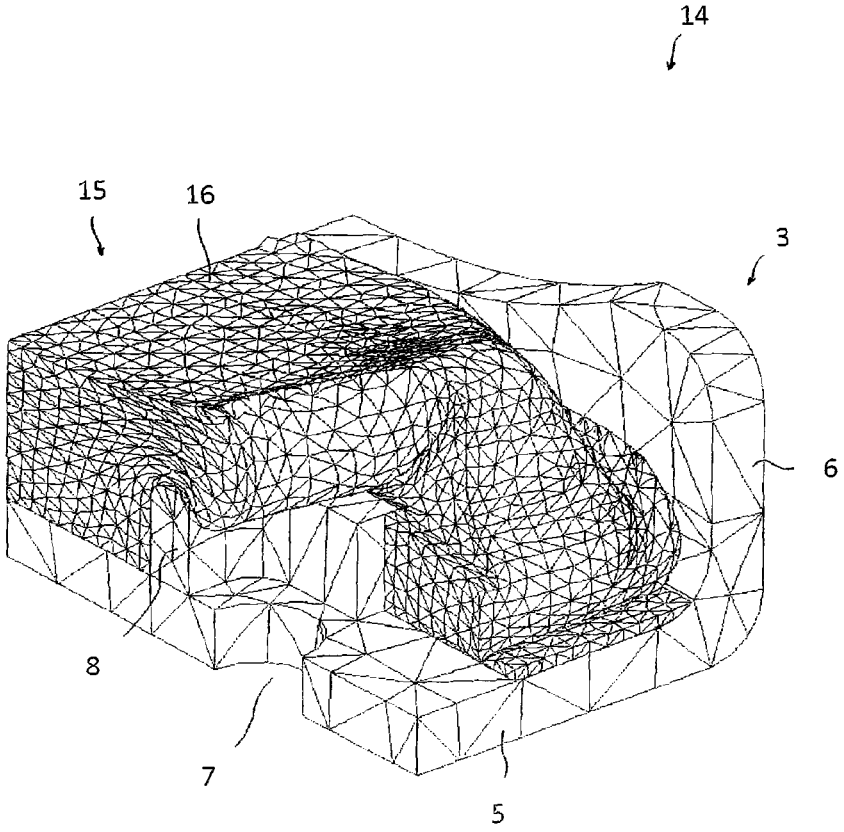
FIG. 22 shows a deformed state of the rubber stopper without a bored section.

FIG. 21 shows a deformed state of the rubber section 4 when the link rod 2 is pressed against the rubber side abutment surface 12 of the rubber stopper 1, and shows deformation of the rubber section 4 obtained by FEM analysis of a quarter model. FIG. 22 shows a deformed state of the rubber section 15 when the link rod 2 is pressed against the rubber side abutment surface 16 of the rubber stopper 14, and shows deformation of the rubber section 15 obtained by FEM analysis of a quarter model.

As shown in FIG. 21, for the rubber stopper 1, the bored section 13 is formed to reduce vertical compression of the portion near the partition wall 8 in the rubber section 4, and thus reduce deformation extending in a length direction, and reduce local stress to, for example, about 2 MPa.

In contrast to this, as shown in FIG. 22, for the rubber stopper 14, the portion near the partition wall 8 in the rubber section 15 is firmly vertically compressed, and thus significantly extended in a length direction and deformed beyond the partition wall 8 to engage a bolt, and, for example, local stress of about 20 MPa is generated.

According to the above configuration, the bored section 13 having a substantially semi-oval shape is formed near the partition wall 8 in the rubber side abutment surface 12. Thus, when the link rod 2 abuts against the rubber side abutment surface 12, the link rod 2 is first brought into contact with a portion except the bored section 13. Then, as the link rod 2 more firmly abuts against the rubber side abutment surface 12, the rubber section 4 is deformed so that the bored section 13 is gradually closed from a portion remote from the partition wall 8. As such, the bored section 13 delays contact of the link rod 2 with a portion near the partition wall 8, and functions as a release margin for releasing deformation of rubber. This can reduce local stress generated by the rubber section 4 being restrained by the partition wall 8 and increase durability of the rubber section 4.

Increasing durability of the rubber section 4 can reduce an area of the rubber side abutment surface 12, and thus a selection range of the bolt space (P) can be increased to set the bolt space (P) within the wide range. For example, the bolt space (P) of the rubber stopper 14 without a bored section is set within a range of 170 to 200 mm, while the bolt space (P) of the rubber stopper 1 having the bored section 13 can be set within a range of 100 to 200 mm.

The link rod 2 is firmly pressed to close the bored section 13. Thus, a spring characteristic of the rubber stopper 1 when the link rod 2 firmly abuts can be substantially the same as that of the rubber stopper 14 without a bored section. Reducing the area of the rubber side abutment surface 12 reduces a spring constant of the rubber section 4. In this case, the spring characteristic of the rubber stopper 1 can be substantially the same as that of the rubber stopper 14 without a bored section by setting hardness of rubber within, for example, a range of A50 to A80 (type A durometer) depending on the area of the rubber side abutment surface 12.

Figure 23:
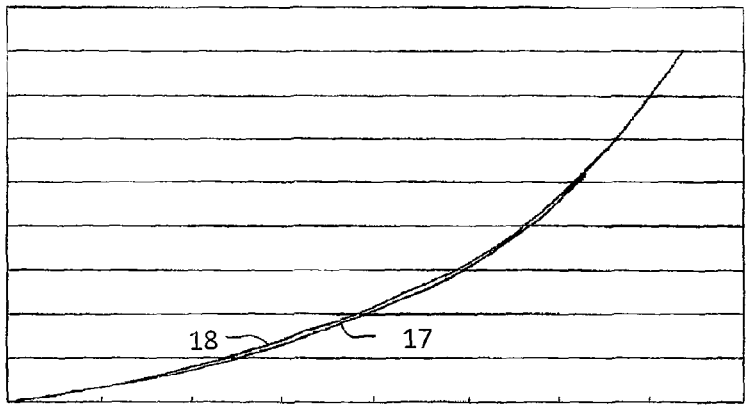
FIG. 23 shows a spring characteristic of the rubber stopper.
Figure 24:
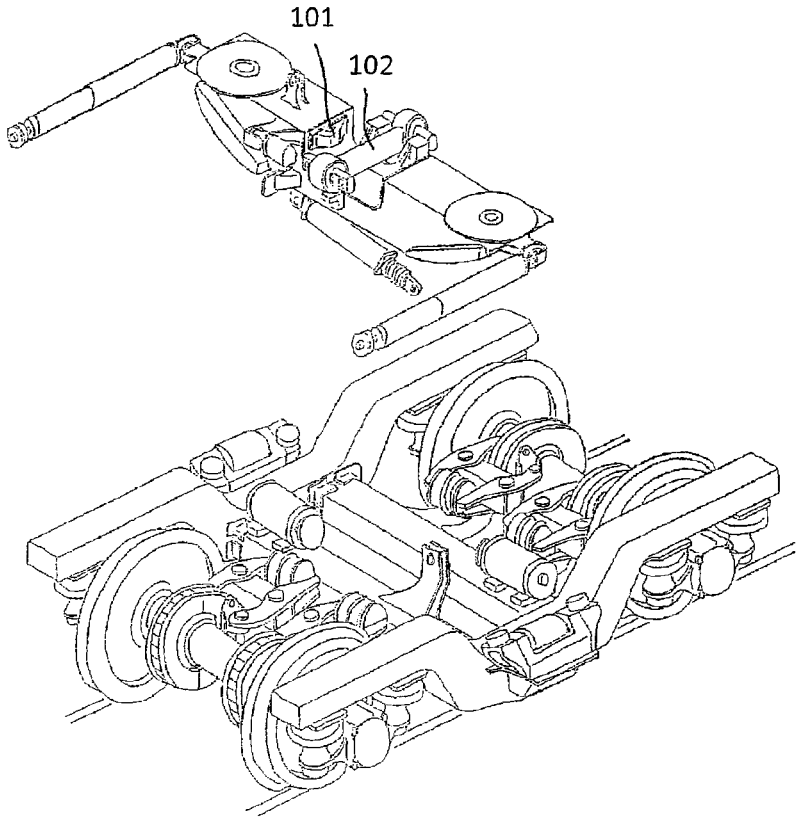
FIG. 24 is a schematic diagram of a bogie structure of a railway vehicle.

For example, in FIG. 23, a spring characteristic 17 of the rubber stopper 1 having the bored section 13 is substantially the same as a spring characteristic 18 of the rubber stopper 14 without a bored section. The ordinate in FIG. 23 represents a load applied to the rubber stopper, and the abscissa represents a displacement amount of the rubber stopper corresponding to each load.

The rubber side abutment surface 12 has substantially the same radius of curvature as the link rod 2 and is brought into surface contact with the link rod 2. Thus, stress can be dispersed to the entire rubber side abutment surface 12 to increase strength and durability of the rubber section 4.

The fitting side abutment surface 10 is formed on the side plate 6 of the holding fitting 3. Thus, the fitting side abutment surface 10 can function as a final stopper when an unexpectedly high load is applied, thereby further increasing safety. Further, the fitting side abutment surface 10 has substantially the same radius of curvature as the link rod 2 and is brought into surface contact with the link rod 2. Thus, stress can be dispersed to the entire fitting side abutment surface 10 to increase strength as the final stopper.

The present invention is not limited to the above-described embodiment, but may be changed within the scope of the present invention. For example, the shape of the bored section 13 is not limited to the substantially semi-oval shape, but may be a spherical surface shape, a tapered shape, or a linear shape.

Even when the link rod 2 does not have a circular shape, the fitting side abutment surface 10 and the rubber side abutment surface 12 may be formed to be brought into surface contact with an outer peripheral surface of the link rod 2. Further, the link rod 2 may be brought into line or point contact with the fitting side abutment surface 10 and the rubber side abutment surface 12. The rubber stopper 1 may limit relative displacement of a plurality of members, and is not limited to a rubber stopper that is mounted to a bogie of a railway vehicle and abuts against a link rod 2, but may be applied to other uses.

What is claimed is:

1. A rubber stopper for limiting relative displacement of a plurality of members, comprising:

a holding fitting fastened by means of bolting to one of the plurality of members; and a rubber section that is held by the holding fitting and abuts against another of the plurality of members, wherein the holding fitting has a partition wall that divides between a peripheral edge of a bolt hole through which a fastening bolt is inserted and a holding section that holds the rubber section, in the rubber section, a rubber side abutment surface that abuts against said another member is provided to protrude from a top of the partition wall, and a bored section is formed near the partition wall;

wherein said bored section of said rubber section that is formed near said partition wall is a recess in said rubber side abutment surface adjacent said partition wall configured such that upon compressing said rubber section by pressure of said another member against said rubber side abutment surface, said rubber section deforms into said recess such as to reduce local stress of the rubber section restrained by said partition wall.

2. The rubber stopper according to claim 1, wherein the rubber side abutment surface is formed to be brought into surface contact with a portion of said another member against which the rubber side abutment surface abuts.

3. The rubber stopper according to claim 1, wherein a fitting side abutment surface that abuts against said another member to limit deformation of the rubber section is formed in the holding fitting, and the fitting side abutment surface is formed to be brought into surface contact with a portion of said another member against which the fitting side abutment surface abuts.

4. The rubber stopper according to claim 1, wherein said partition wall is configured to extend around a portion of said peripheral edge of said bolt hole.

5. The rubber stopper according to claim 4, wherein said partition wall is configured to curve around a portion of said peripheral edge of said bolt hole.

6. The rubber stopper according to claim 5, wherein said bored section is formed in said rubber section adjacent the portion of said partition wall that curves around the portion of said peripheral edge of said bolt hole.

7. The rubber stopper according to claim 6, wherein said bored section is formed into a curved shape.

8. The rubber stopper according to claim 7, wherein said bored section is formed into a semi-oval shape.

9. The rubber stopper according to claim 6, wherein said bored section has a bottom that is set to a depth that is higher than a top of the partition wall and a width that is narrower than that of the partition wall.

10. The rubber stopper according to claim 4, wherein said bored section is formed in said rubber section adjacent the portion of said partition wall that extends around the portion of said peripheral edge of said bolt hole.

11. The rubber stopper according to claim 10, wherein said bored section is formed into a curved shape.

12. The rubber stopper according to claim 11, wherein said bored section is formed into a semi-oval shape.

13. The rubber stopper according to claim 11, wherein said bored section has a bottom that is set to a depth that is higher than a top of the partition wall and a width that is narrower than that of the partition wall.

14. A rubber stopper for limiting relative displacement of a plurality of members, comprising:

a holding fitting fastened by means of bolting to one of the plurality of members; and a rubber section that is held by the holding fitting and abuts against another of the plurality of members, wherein the holding fitting has a partition wall that divides between a peripheral edge of a bolt hole through which a fastening bolt is inserted and a holding section that holds the rubber section, in the rubber section, a rubber side abutment surface that abuts against said another member is provided to protrude from a top of the partition wall, and a bored section is formed near the partition wall, wherein the rubber stopper is fastened to a bogie side of a railway vehicle by a bolt so that the rubber side abutment surface abuts against a link rod that connects the bogie side and a vehicle body to transmit forward and rearward forces to limit lateral movement of the link rod relative to the bogie side and limit lateral movement of the vehicle body side.

15. A rubber stopper for limiting relative displacement of a plurality of members, comprising:

a holding fitting fastened by means of bolting to one of the plurality of members; and a rubber section that is held by the holding fitting and abuts against another of the plurality of members, wherein the holding fitting has a partition wall that divides between a peripheral edge of a bolt hole through which a fastening bolt is inserted and a holding section that holds the rubber section, in the rubber section, a rubber side abutment surface that abuts against said another member is provided to protrude from a top of the partition wall, and a bored section is formed near the partition wall, wherein the rubber side abutment surface is formed to be brought into surface contact with a portion of said another member against which the rubber side abutment surface abuts, wherein the rubber stopper is fastened to a bogie side of a railway vehicle by a bolt so that the rubber side abutment surface abuts against a link rod that connects the bogie and a vehicle body side to transmit forward and rearward forces to limit lateral movement of the link rod relative to the bogie side and limit lateral movement of the vehicle body side.

16. A rubber stopper for limiting relative displacement of a plurality of members, comprising:

a holding fitting fastened by means of bolting to one of the plurality of members; and a rubber section that is held by the holding fitting and abuts against another of the plurality of members, wherein the holding fitting has a partition wall that divides between a peripheral edge of a bolt hole through which a fastening bolt is inserted and a holding section that holds the rubber section, in the rubber section, a rubber side abutment surface that abuts against said another member is provided to protrude from a top of the partition wall, and a bored section is formed near the partition wall, wherein a fitting side abutment surface that abuts against said another member to limit deformation of the rubber section is formed in the holding fitting, and the fitting side abutment surface is formed to be brought into surface contact with a portion of said another member against which the fitting side abutment surface abuts, wherein the rubber stopper is fastened to a bogie side of a railway vehicle by means of bolting so that the rubber side abutment surface abuts against a link rod that connects the bogie side and a vehicle body side to transmit forward and rearward forces to limit lateral movement of the link rod relative to the bogie and limit lateral movement of the vehicle body side.

* * * * *